US011466684B2

(12) United States Patent
Park et al.

(10) Patent No.: US 11,466,684 B2
(45) Date of Patent: Oct. 11, 2022

(54) COMPRESSOR WITH FLOW PATH GUIDE THAT SEPARATES A REFRIGERANT FLOW PATH FROM AN OIL FLOW PATH

(71) Applicant: LG ELECTRONICS INC., Seoul (KR)

(72) Inventors: Jun Ha Park, Seoul (KR); Nara Han, Seoul (KR); Hae Jin Park, Seoul (KR); Sangjin Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 116 days.

(21) Appl. No.: 17/181,140

(22) Filed: Feb. 22, 2021

(65) Prior Publication Data

US 2021/0262467 A1 Aug. 26, 2021

(30) Foreign Application Priority Data

Feb. 26, 2020 (KR) ..... 10-2020-0023775

(51) Int. Cl.

| | |
|---|---|
| ***F04C 18/02*** | (2006.01) |
| ***F04C 23/00*** | (2006.01) |
| ***F04C 29/02*** | (2006.01) |
| ***F04C 29/12*** | (2006.01) |

(52) U.S. Cl.

CPC ..... *F04C 18/0215* (2013.01); *F04C 23/008* (2013.01); *F04C 29/026* (2013.01); (Continued)

(58) Field of Classification Search

CPC ..... F04C 2/025; F04C 18/0207–0292; F04C 15/0088; F04C 15/0092; F04C 15/06; (Continued)

(56) References Cited

U.S. PATENT DOCUMENTS

2016/0040672 A1* 2/2016 Lee ..... F04C 29/028 417/410.5
2017/0306964 A1* 10/2017 Kim ..... F04C 29/026
(Continued)

FOREIGN PATENT DOCUMENTS

CN 101539141 9/2009
CN 105370576 3/2016
(Continued)

OTHER PUBLICATIONS

Korean Office Action dated Jun. 8, 2021 issued in KR Application No. 10-2020-0023775.

(Continued)

*Primary Examiner* — Laert Dounis
(74) *Attorney, Agent, or Firm* — Ked & Associates

(57) ABSTRACT

A compressor may include a casing; an electric motor provided in the casing and that operates a rotational shaft; and a compression device. A flow path guide may be installed between the electric motor and the compression device, and may separate a refrigerant flow path from an oil flow path. The flow path guide may have a first partition wall and a second partition wall which are spaced apart from each other. In addition, the flow path guide may have an oil discharge port formed in at least a section of the flow path guide along a circumferential direction thereof, the oil discharge port allowing a guide space between the first partition wall and the second partition wall to be open toward the inner surface of the casing.

20 Claims, 11 Drawing Sheets

(52) U.S. Cl.
CPC ..... *F04C 29/12* (2013.01); *F04C 2240/30* (2013.01); *F04C 2240/40* (2013.01)

(58) Field of Classification Search
CPC ..... F04C 29/02–028; F04C 29/12; F01C 1/0207–0292; F01C 21/04; F01C 21/045; F01C 21/18
See application file for complete search history.

(56) References Cited

U.S. PATENT DOCUMENTS

| | | | | |
|---|---|---|---|---|
| 2018/0298901 | A1* | 10/2018 | Lee | F04C 18/0215 |
| 2018/0328362 | A1* | 11/2018 | Kim | F04C 29/026 |
| 2019/0353163 | A1* | 11/2019 | Jeon | F04C 29/045 |

FOREIGN PATENT DOCUMENTS

| | | |
|---|---|---|
| CN | 109072909 | 12/2018 |
| JP | 2009-228437 | 10/2009 |
| KR | 10-1156120 | 6/2012 |
| KR | 10-2016-0017993 | 2/2016 |
| KR | 10-2018-0083646 | 7/2018 |
| KR | 10-2018-0115174 | 10/2018 |
| KR | 10-2019-0005590 | 1/2019 |

OTHER PUBLICATIONS

Korean Office Action issued in Application No. 202110149199.4 dated Aug. 1, 2022.

* cited by examiner

COMPRESSOR WITH FLOW PATH GUIDE THAT SEPARATES A REFRIGERANT FLOW PATH FROM AN OIL FLOW PATH

CROSS-REFERENCE TO RELATED APPLICATION(S)

The present application claims priority to Korean Patent Application No. 10-2020-0023775, filed in Korea on Feb. 26, 2020, the entire contents of which is incorporated herein for all purposes by this reference.

BACKGROUND

1. Field

A compressor is disclosed herein.

2. Background

Generally, a compressor is a mechanical device used for increasing the pressure of a fluid or transferring a high-pressure fluid, and the compressor may be applied to a refrigeration cycle of a refrigerator or an air conditioner to compress refrigerant gas and transfer the compressed refrigerant gas to a condenser. More particularly, a scroll compressor is a compressor having a fixed scroll fixed in an inner space of a casing and an orbiting scroll engaged with the fixed scroll so as to perform an orbiting movement, whereby suction, gradual compression, and discharge of a refrigerant are continuously and repetitively performed by a compression chamber continuously defined between a fixed wrap of the fixed scroll and an orbiting wrap of the orbiting scroll.

Recently, a lower compression type of a high-pressure compressor has been proposed, in which a compression device composed of the fixed scroll and the orbiting scroll is located under an electric motor that transmits power to orbit the orbiting scroll, and directly receives and compresses refrigerant gas, and then transfers the refrigerant gas to an upper space inside of the casing to be discharged. Compressors such as this are disclosed in Korean Patent Application Publication No. 10-2018-0083646 (hereinafter, "Patent Document 1") and in Korean Patent Application Publication No. 10-2018-0115174 (hereinafter, "Patent Document 2"), which are hereby incorporated by reference.

In such a lower compression type compressor, refrigerant discharged to the inner space of the casing flows to a discharge tube located at an upper portion of the casing, but oil is recovered to an oil storage space provided at a lower side of the compression device. In this process, oil may be discharged outside of the compressor mixed with refrigerant, or may stagnate on an upper side of the electric motor by being pushed by pressure of the refrigerant.

In addition, in the lower compression type compressor, oil mixed with refrigerant discharged from the compression device passes through the electric motor (a motor) and flows to an upper portion of the electric motor. At the same time, oil on the upper portion of the electric motor may pass through the electric motor and flow to a lower portion of the electric motor. Accordingly, the oil flowing downward may mix with refrigerant discharged from the compression device and be discharged outside, or due to high-pressure refrigerant flowing upward, the oil may not flow to a lower side of the electric motor. In this case, an amount of the oil recovered to the oil storage space may substantially decrease, and thus, the amount of oil supplied to the compression device may decrease, whereby friction loss or abrasion of the compression device may be caused.

To solve this, in Korean Patent Application Publication No. 10-2016-0017993 (hereinafter, "Patent Document 3"), which is hereby incorporated by reference, related art is disclosed in which a flow path guide is provided to separate a discharge path of refrigerant gas from a discharge path of oil. However, when such a flow path guide is provided, the flow path guide may define a closed space, and cause oil to accumulate therein, preventing recovery of the oil.

In addition, when the amount of the oil collected in the flow path guide increases, some of the oil may flow to a balance weight located at a center of the compressor. In this case, the oil may be splattered by the balance weight, which is rotating, and thus, oil recovery may become more difficult.

BRIEF DESCRIPTION OF THE DRAWINGS

Embodiments will be described in detail with reference to the following drawings in which like reference numerals refer to like elements, and wherein.

DETAILED DESCRIPTION

Figure 1:
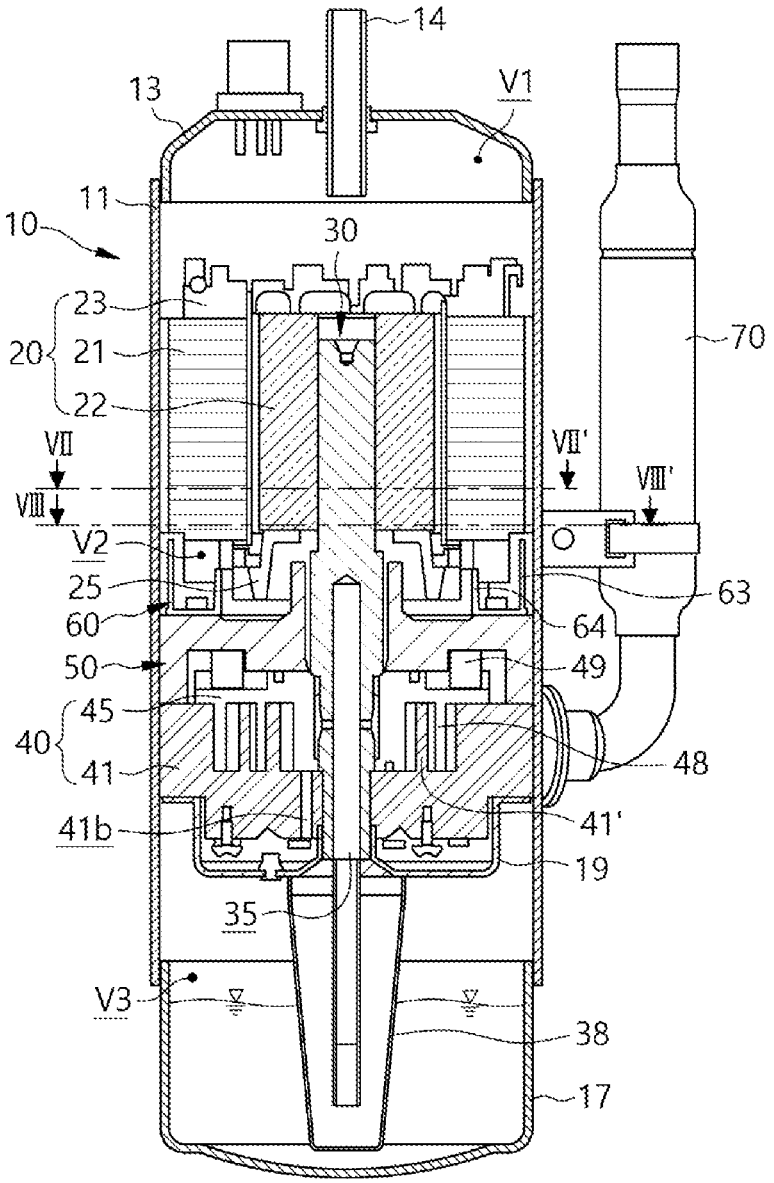
FIG. 1 is a cross-sectional view of a compressor according to an embodiment.

Hereinbelow, embodiments will be described with reference to the accompanying drawings. In adding reference numerals to components of each drawing, it should be noted that the same or like reference numerals are assigned to the same or like components as much as possible even though they are shown in different drawings. In addition, in describing embodiments, descriptions of related known configurations or functions have been omitted.

In addition, in describing components of embodiments, terms such as first, second, A, B, a, and b may be used. These terms are only to distinguish the components from other components, and the nature or order, etc. of the components is not limited by the terms. When a component is described as being "connected", "coupled", or "joined" to other components, that component may be directly connected or joined to the other components, and it will be understood that other components between each component may be "connected", "coupled", or "joined" to each other.

The compressor according to an embodiment may include a casing 10; an electric motor 20; a compression device 40; a main frame 50; and a rotational shaft 30. An upper oil recovery flow path Pb1 and a lower oil recovery flow path Pb2 may be formed on an inner surface of the casing 10, so that oil may be recovered to an oil storage space V3 located at a lower side of the compressor. In the embodiment, the oil recovery flow path Pb1 and Pb2 may be configured to have as large a cross-sectional area as possible, so that a recovery rate of oil may be high. Such a structure will be described hereinafter.

The casing 10 may form an exterior of the compressor. The casing 10 may include a body 11 having a shape of a cylinder open at upper and lower ends. Further, the open upper end of the body 11 may be closed by an upper shell 13, and the open lower end of the body 11 may be closed by a lower shell 17.

A space defined in the upper shell 13, together with an inner upper portion of the casing 10, may be a discharge space V1 through which a refrigerant gas is discharged, and a space defined in the lower shell 17 may be the oil storage space V3 in which oil is stored. A refrigerant discharge tube 14 may extend through the upper shell 13 to discharge the refrigerant gas from the discharge space V1. For reference, FIG. 1 illustrates a state in which oil is stored in the oil storage space V3.

The electric motor 20 may be installed inside of the casing 10, and supply a drive force to rotate the rotational shaft 30. The electric motor 20 may be positioned at a lower side of the discharge space V1 at an upper side space in the casing 10. The electric motor 20 may include a stator 21 installed by being fixed to an inner circumferential surface of the casing 10 and a rotor 22 installed to be rotatable in the stator 21.

The stator 21 may include multiple stator cores which are laminated, and a coil wound on the stator cores. Insulators 23 and 24 may be provided at upper and lower sides of the laminated stator cores, respectively, to wind and insulate the coil. The insulators 23 and 24 may be made of an insulating material, such as synthetic resin. The insulators may include insulator 23 provided at an upper side of the electric motor 20, and insulator 24 provided at a lower side of the electric motor 20.

The rotor 22 may be a hollow magnet, which is roughly cylinder-shaped, and be installed to be rotatable in the stator 21. The rotational shaft 30 may be coupled to the rotor 22, so that the rotor 22 and the rotational shaft 30 may rotate together.

A balance weight 25 that suppresses noise and vibration may be coupled to the rotor 22 or the rotational shaft 30. The balance weight 25 may be provided between the electric motor 20 and the compression device 40, that is, in a transfer space V2. As the balance weight 25 rotates together with the rotor 22, the balance weight 25 may splatter oil mixed with refrigerant gas, and thus, may cause the oil to fail to be efficiently recovered. However, a flow path guide 60 according to embodiments may prevent such a phenomenon.

In addition, an oil flow path 35 may be formed inside of the rotational shaft 30 to supply oil to each sliding component, and an oil feeder 38 may be installed at a lower side of the rotational shaft 30 such that the oil feeder 38 is immersed in oil stored in the oil storage space V3 defined inside of the casing 10, and may transfer the oil of the oil storage space V3 to the oil flow path 35. That is, as the oil present in the oil storage space V3 is suctioned upward through the oil flow path 35 by rotation of the oil feeder 38 caused by rotation of the rotational shaft 30, the oil may be supplied to each sliding component and the electric motor 20.

The compression device 40 may compress the refrigerant gas. The compression device 40 may be located at the lower side of the electric motor 20 in a lower side space in the casing 10. The compression device 40 may include a fixed scroll 41 fixed to an inside of the casing 10 and having a fixed wrap 41', and an orbiting scroll 45 having an orbiting wrap 48 engaged with the fixed wrap 41' of the fixed scroll 41 and configured to orbit by receiving the drive force of the rotational shaft 30.

The fixed scroll 41 may be located at a relatively lower side inside of the compression device 40, and the orbiting scroll 45 may be located at a relatively upper side inside of the compression device 40, so the fixed scroll 41 and the orbiting scroll 45 may face each other. In addition, a compression chamber may be continuously formed between the interlocked scroll wraps formed on surfaces facing each other in the fixed scroll 41 and the orbiting scroll 45.

In addition, a discharge port 41*b* may be provided in a lower surface of the fixed scroll 41 such that the refrigerant gas compressed in the compression chamber may be discharged to the lower space of an inner portion of the casing 10. The discharge port 41*b* may extend in an axial direction of the rotational shaft 30, and may be open to upper and lower portions of the fixed scroll 41. Centers of the fixed scroll 41 and the orbiting scroll 45 may be formed to be open such that the rotational shaft 30 passes through the centers.

A refrigerant introduction port (no reference numeral given) may be connected to a circumference of the fixed scroll 41 to communicate therewith. The refrigerant introduction port may pass through a circumference of the casing 10, and the refrigerant introduction port may be connected to an accumulator 70 so as to receive refrigerant gas therefrom. That is, refrigerant gas introduced through the accumulator 70 to the refrigerant introduction port may be introduced to a compression chamber which is a space located between the fixed scroll 41 and the orbiting scroll 45.

As illustrated in FIG. 1, the fixed wrap 41' may be provided at the center of the fixed scroll 41 of the compression device 40. Further, a first refrigerant discharge port 42 may be provided in a fixed body of the fixed scroll 41. The first refrigerant discharge port 42 may be formed through the fixed scroll 41 in a thickness direction of the fixed scroll 41. The refrigerant discharged after being compressed in the compression chamber may flow upward through the first refrigerant discharge port 42.

The first refrigerant discharge port 42 may be arranged at a position close to an outer edge of the fixed scroll 41. That is, the first refrigerant discharge port 42 may be located radially outward with respect to the compression chamber defined by the fixed wrap 41' and the orbiting wrap 48. Accordingly, a first oil recovery flow path 44 described hereinafter may be formed at a position at which it does not interfere with the first refrigerant discharge port 42.

Although not shown, multiple first fastening holes may be formed in the fixed scroll 41. The first fastening holes are employed to assemble the fixed scroll 41 with the main frame 50, and fasteners, such as bolts, may be inserted into the first fastening holes from a lower side of the fixed scroll 41. At least a portion of a bolt inserted into each of the first fastening holes may pass through the first fastening hole and protrude toward the main frame 50, and a protruding portion of the bolt may be inserted into a lower surface of the main frame 50 described hereinafter.

Figure 4:
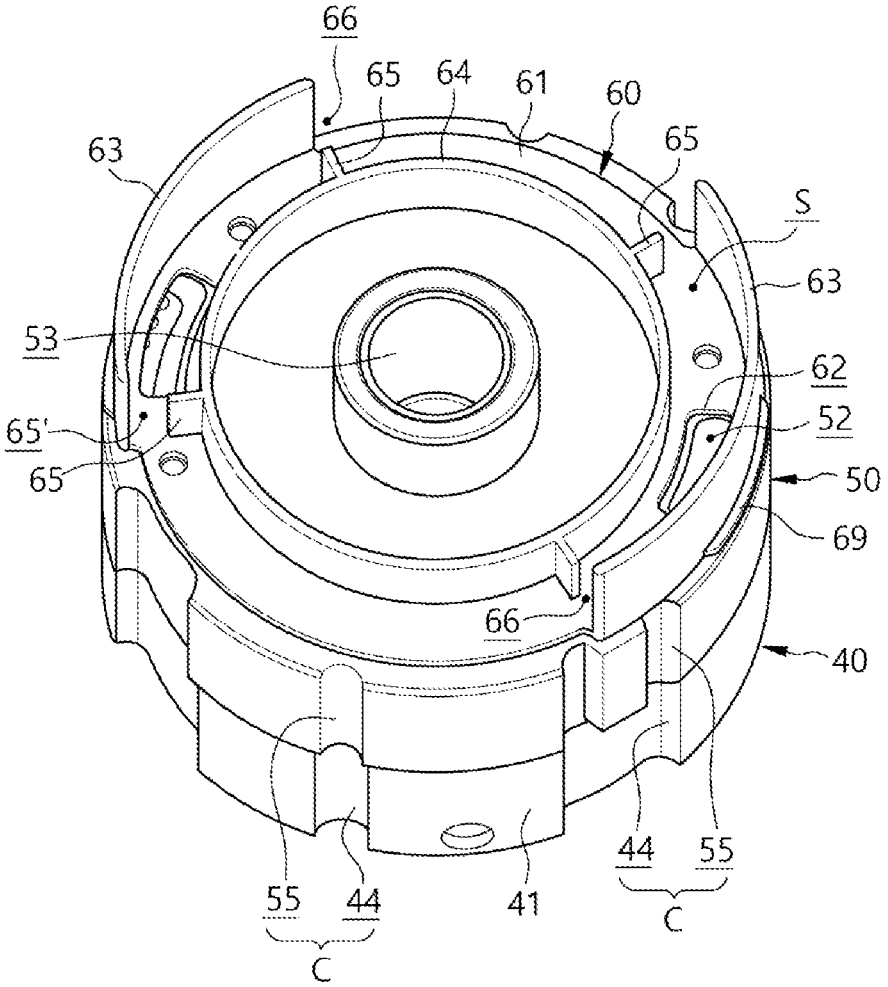
FIG. 4 is a perspective view of the compression device and a flow path guide of the compressor according to an embodiment.

The first oil recovery flow path 44 may be formed at an outer circumferential surface of the fixed scroll 41. The first oil recovery flow path 44 may a path that allows oil collected in or at an upper surface of the main frame 50 to be recovered to a lower side thereof, more precisely, to the oil storage space V3. As illustrated in FIG. 4, the first oil recovery flow path 44 may form an oil flow path C which is a continuous path in cooperation with a second oil recovery flow path 55 of the main frame 50 described hereinafter. The oil flow path C may form the lower oil recovery flow path Pb2 between the oil flow path C and the inner surface of the casing 10.

The first oil recovery flow path 44 may extend in the thickness direction of the fixed scroll 41. Referring to FIG. 4, the first oil recovery flow path 44 may extend in a vertical direction. The first oil recovery flow path 44 may be formed in the shape of a hole at a position adjacent to the outer circumferential surface of the fixed scroll 41, or may be recessed from the outer circumferential surface thereof in a semicircular shape. In this embodiment, the first oil recovery flow path 44 is formed in a side surface of the fixed scroll 41, and may be open in a direction facing the inner surface of the casing 10 facing the fixed scroll 41.

The first oil recovery flow path 44 may be formed by two vertical edges at which the first oil recovery flow path 44 and the outer circumferential surface of the fixed scroll 41 meet each other and two horizontal edges formed by extending the two vertical edges in a circumferential direction of the fixed scroll 41. Accordingly, an area of the path for oil formed by the first oil recovery flow path 44 may be a cross-sectional area of space defined between the first oil recovery flow path 44 and the inner circumferential surface of the casing 10.

The first oil recovery flow path 44 may be formed at a position avoiding the first fastening holes and the first refrigerant discharge port 42 formed in the fixed scroll 41. The multiple first fastening holes and the first refrigerant discharge port 42 may be formed in the fixed scroll 41, so that the first oil recovery flow path 44 may be formed at a position at which the first fastening holes and the first refrigerant discharge port 42 are not located.

The first oil recovery flow path 44 may include multiple first oil recovery flow paths formed in the outer circumferential surface of the fixed scroll 41 along the circumferential direction of the fixed scroll 41. Each of the first oil recovery flow paths 44 may not be formed in a same shape and size, but may be formed in various shapes and sizes. In addition, upper and lower portions of the first oil recovery flow path 44 may have cross-sectional areas having different sizes relative to the thickness direction of the fixed scroll 41.

The orbiting scroll 45 may be coupled to the fixed scroll 41. The orbiting scroll 45 may be installed in a space defined between the fixed scroll 41 and the main frame 50, and may be connected to the rotational shaft 30. The orbiting scroll 45 may function to compress refrigerant while rotating with the rotational shaft 30.

A shaft fixing hole to which the rotational shaft 30 may be fixed may be formed in a center of a scroll body forming the orbiting scroll 45, and the orbiting wrap 48 may protrude downward from a lower side of the scroll body. The orbiting wrap 48 may face the fixed wrap 41' of the fixed scroll 41, and may define the compression chamber which is changeable in volume therebetween.

An Oldham ring 59 may be installed at an upper side of the orbiting scroll 45 so as to prevent rotation of the orbiting scroll 45 on an axis thereof. The Oldham ring 59 may include a body fitted to the orbiting scroll 45 and having a ring shape having a substantially circular shape, and a first key (not shown) and a second key (not shown) that protrude from the body in upward and downward directions, respectively. Such an Oldham ring 59 has a well-known configuration, so description thereof has been omitted.

Main frame 50 may be installed between the compression device 40 and the electric motor 20. The main frame 50 may support operations of the orbiting scroll 45 and the rotational shaft 30, and may function to support the electric motor 20. A support body 51 configured to be disposed between the compression device 40 and the electric motor 20 may form an exterior of the main frame 50. The support body 51 of the main frame 50 may be a portion of the fixed scroll 41 of the compression device 40, or may be omitted.

A second refrigerant discharge port 52 may be provided in the support body 51 of the main frame 50. The second refrigerant discharge port 52 may be a path through which refrigerant gas compressed in the compression device 40 flows upward, and may be connected to the first refrigerant discharge port 42 described above, so that first refrigerant flow path Pa1 which is continuous between the second refrigerant discharge port 52 and the first refrigerant discharge port 42 may be formed. Accordingly, compressed refrigerant gas may pass through the first refrigerant discharge port 42 and the second refrigerant discharge port 52, and may pass through a second refrigerant flow path Pa2 located in the electric motor 20, and then may be transferred to the discharge space V1.

A shaft insertion hole 53 into which the rotational shaft 30 may be inserted may be formed in or at a center of the main frame 50, and the support body 51 may be approximately disk-shaped relative to the shaft insertion hole 53. Multiple second fastening holes, in addition to the second refrigerant discharge port 52, may be formed in the support body 51. The second fastening holes may include a guide coupling hole 58 that allows the flow path guide 60 to be coupled to an upper portion of the main frame 50, and a bolt fastening hole (not shown) that allows the main frame 50 to be coupled to the fixed scroll 41.

Figure 5:
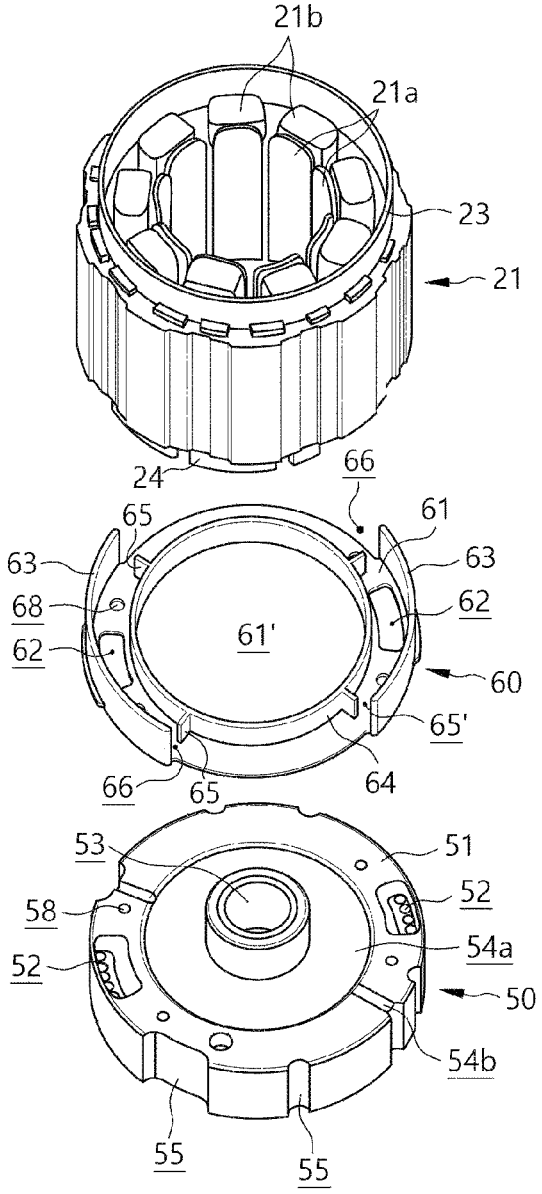
FIG. 5 is an exploded perspective view of a main frame and the flow path guide of the compressor according to an embodiment.

As illustrated in FIG. 5, an oil pocket 54*a* may be formed in an upper surface of the main frame 50 so as to collect oil discharged between the shaft insertion hole 53 and the rotational shaft 30, and a connection flow path 54*b* may be formed at a side of the oil pocket 54*a* so as to connect the oil pocket 54*a* to the second oil recovery flow path 55. The oil pocket 54*a* may be depressed or recessed in the upper surface of the main frame 50, and may have a ring shape along an outer circumferential surface of the shaft insertion hole 53. The connection flow path 54*b* may be a depressed groove or recess in the upper surface of the main frame 50. The connection flow path 54*b* may communicate with a space between a first partition wall 63 and a second partition wall 64, which are described hereinafter, and thus, may be exposed to refrigerant. A cover may be provided between the connection flow path 54*b* and the space between the first partition wall 63 and the second partition wall 64; however, such cover is omitted in the drawing.

The second oil recovery flow path 55 may be formed in the main frame 50. The second oil recovery flow path 55 may be a path that allows oil collected in the upper surface of the main frame 50 to be recovered to the lower side thereof, more precisely, to the oil storage space V3. The second oil recovery flow path 55 may form a continuous path in cooperation with the first oil recovery flow path 44 of the fixed scroll 41 described hereinafter.

The second oil recovery flow path 55 may extend in a thickness direction of the main frame 50. Referring to FIG.

4, the second oil recovery flow path 55 may be formed in a vertical direction. The second oil recovery flow path 55 may be formed in the shape of a hole at a position adjacent to an outer circumferential surface of the main frame 50, or may be recessed from the outer circumferential surface thereof in a semicircular shape. In this embodiment, the second oil recovery flow path 55 is formed in a side surface of the main frame 50, and may be open in a direction facing the inner surface of the casing 10 facing the main frame 50.

The second oil recovery flow path 55 may be formed by two vertical edges at which the second oil recovery flow path 55 and the outer circumferential surface of the main frame 50 meet each other and two horizontal edges formed by extending one of the two vertical edges in the circumferential direction of the main frame 50. Accordingly, an area of the path for oil formed by the second oil recovery flow path 55 may be a cross-sectional area of space defined between the second oil recovery flow path 55 and the inner circumferential surface of the casing 10.

The second oil recovery flow path 55 may be formed at a position avoiding the second fastening holes and the second refrigerant discharge port 52 formed in the main frame 50. In the main frame 50, there is the second refrigerant discharge port 52 in addition to the guide coupling hole 58 and the bolt fastening hole of the second fastening holes. The bolt fastening hole allows the main frame 50 to be coupled to the fixed scroll 41, so that the second oil recovery flow path 55 may be formed at a position at which the second fastening holes and the second refrigerant discharge port 52 are not located.

The second oil recovery flow path 55 may include multiple second oil recovery flow paths formed in the outer circumferential surface of the main frame 50 along a circumferential direction of the main frame 50. Each of the second oil recovery flow paths 55 may not be formed in a same shape and size, but may be formed in various shapes and sizes.

The second oil recovery flow path 55 may form a continuous path in cooperation with the first oil recovery flow path 44, as illustrated in FIG. 4. Such a continuous path may extend in the direction of gravity. Accordingly, oil collected in the upper portion of the main frame 50 may move downward while continuously passing through the second oil recovery flow path 55 and the first oil recovery flow path 44, and finally may collect in the oil storage space V3.

The guide coupling hole 58 of the main frame 50 may be open in the upper surface of the main frame 50 upward toward the flow path guide 60. The guide coupling hole 58 may be located at a same position as a fastening hole 68 of the flow path guide 60 described hereinafter, so that the flow path guide 60 and the main frame 50 may be coupled to each other by a fastener, such as a bolt B.

The flow path guide 60 may be installed on the main frame 50. The flow path guide 60 may be fixed to the main frame 50 by the guide coupling hole 58 of the main frame 50, and function to separate the flow of refrigerant gas from the downwardly-flowing oil using the partition walls 63 and 64. More particularly, the flow path guide 60 may be formed to have the shape of a ring having an open center, and may be fixed to an upper surface of the support body 51 forming the main frame 50.

More particularly, the flow path guide 60 may be installed between the electric motor 20 and the compression device 40, and may function to separate the refrigerant flow path from the oil flow path. A guide space S may be provided in the flow path guide 60 and guide refrigerant gas discharged by being compressed in the compression device 40 toward the electric motor 20. At the same time, the flow path guide 60 may separate the recovery flow path of oil, in which the oil flows downward after being separated from the refrigerant gas after passing through the electric motor 20 with refrigerant gas and being discharged to the discharge space V1, from the discharge path of refrigerant gas such that the oil is efficiently recovered.

Figure 6:
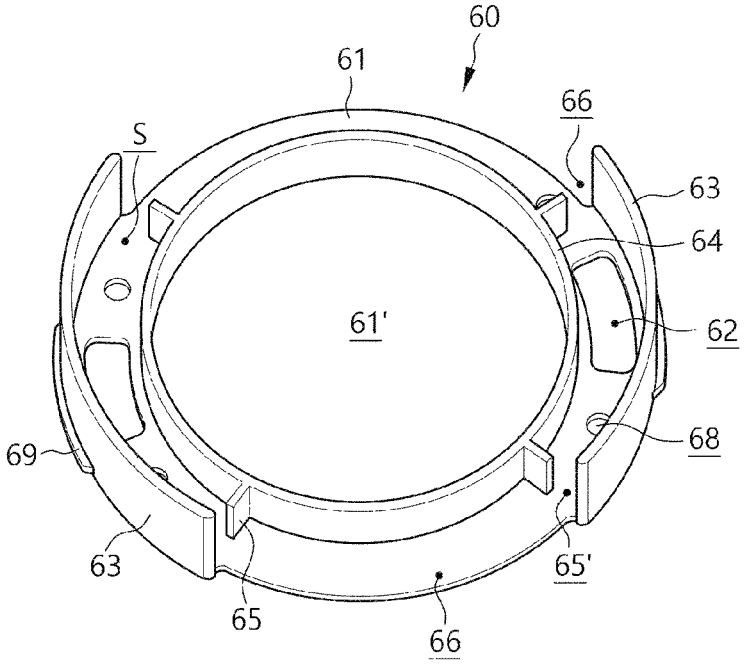
FIG. 6 is a perspective view of the flow path guide of the compressor according to an embodiment.

As illustrated in FIGS. 4 to 6, referring to the structure of the flow path guide 60, the flow path guide 60 may have a substantially ring shape having an empty center, and the empty center may be through hole 61'. The balance weight 25 may be located in the through hole 61'. Fastening hole 68 corresponding to the guide coupling hole 58 may be formed through the flow path guide 60.

The flow path guide 60 may include a guide body 61 having a ring-shaped flat plate structure; first partition wall 63 provided integrally with the guide body 61; and second partition wall 64. The first partition wall 63 may have an arc shape along an outer edge of the guide body 61, and may extend in a vertical direction while facing the inner surface of the casing 10. Additionally, the second partition wall 64 may have a circular shape along an edge of the through hole 61', and may define guide space S in cooperation with the guide body 61 and the first partition wall 63. The guide space S may form a portion of the transfer space V2 described above.

The guide space S may be a space defined between the first partition wall 63 and the second partition wall 64, and function to upwardly guide refrigerant gas discharged through a connection hole 62 formed through the guide body 61, that is, toward the electric motor 20. That is, the refrigerant gas may be blocked by the first partition wall 63 and the second partition wall 64, and thus, may not be discharged in a lateral direction, but may be discharged toward an upper side of the flow path guide open between the first partition wall 63 and the second partition wall 64.

That is, the flow path guide 60 may include the first partition wall 63 arranged between the refrigerant flow path and the oil flow path; the second partition wall 64 provided between the rotational shaft 30 and the first partition wall 63; and the guide body 61 that connects the first partition wall 63 to the second partition wall 64 in the transfer space V2 corresponding to a position between the flow path guide 60 and the electric motor 20.

The first partition wall 63 may have a substantially ring shape. An upper end of the first partition wall 63 may be located between an exit of the upper oil recovery flow path Pb1 and an entrance of the second refrigerant flow path Pa2, and a lower end of the first partition wall 63 may be located between an entrance of the lower oil recovery flow path Pb2 and an exit of the first refrigerant flow path Pa1. Accordingly, the first partition wall 63 may separate the upper oil recovery flow path Pb1 formed between the inner surface of the casing 10 and the outer circumferential surface of the stator 21 from the second refrigerant flow path Pa2 which is formed in a slot 21*a* of the stator 21 and a gap between the stator 21 and the rotor 22.

The lower oil recovery flow path Pb2 formed between the inner surface of the casing 10 and an outer surface of the compression device 40 and the upper oil recovery flow path Pb1 may communicate with each other, and the first refrigerant flow path Pa1 formed between a discharge side of the compression device 40 and the transfer space V2 and the second refrigerant flow path Pa2 may communicate with each other. The lower end and upper end of the first partition wall 63 may be in close contact with the main frame 50 and the stator 21, respectively, but in consideration of damage during assembly and operation, any one side of the lower and upper ends may be installed to be spaced apart from the counterpart thereof by assembly tolerance to minimize leakage of refrigerant.

The second partition wall 64 may prevent refrigerant and oil from being mixed with each other by rotation of the rotational shaft 30 and the balance weight 25 in the transfer space V2. The second partition wall 64 may be arranged between the entrance of the second refrigerant flow path Pa2 and the rotational shaft 30, or may be arranged between the exit of the first refrigerant flow path Pa1 and the balance weight 25.

The second partition wall 64 may have the shape of a ring having a radius smaller than a radius of the first partition wall 63. Additionally, the lower end of the second partition wall 64 may be located between the exit of the first refrigerant flow path Pa1 and the rotational shaft 30 or the balance weight 25, and the upper end of the second partition wall 64 may be located at a side lower than the stator 21 and the rotor 22.

In addition, like the first partition wall 63, the lower end of the second partition wall 64 may be in close contact with the main frame 50, and the upper end of the second partition wall 64 may be spaced apart from the stator 21. During assembly or operation of the compressor, the second partition wall 64 may be prevented from being damaged between the stator 21 and the main frame 50, and a path toward the entrance of the second refrigerant flow path Pa2 may be widened such that refrigerant may efficiently flow from the transfer space V2 to the discharge space V1. That is, the second partition wall 64 may be spaced apart from the stator 21 such that the refrigerant discharged from the first refrigerant flow path Pa1 may flow through the slot 21*a* of the stator 21 and through the gap between the stator 21 and the rotor 22.

Accordingly, in this embodiment, for efficient flow of refrigerant gas, the first partition wall 63 may extend higher than the second partition wall 64 along the direction of the rotational shaft 30. That is, the second partition wall 64 may be lower than the first partition wall 63. Refrigerant gas may be efficiently discharged through a space between the second partition wall 64 and the electric motor 20, and the first partition wall 63 may be formed to be relatively high, and thus, may tightly connect the upper oil recovery flow path Pb1 to the lower oil recovery flow path Pb2, through which oil is recovered.

The second partition wall 64 may be configured to have a height higher than or the same as a height of an outer portion of the balance weight 25, which is a portion farthest from a rotational center of the balance weight 25. This is intended to effectively prevent a stirring effect caused by the balance weight 25 as the portion farthest from the rotational center of the balance weight 25 is larger in a rotational radius than other portions of the balance weight 25, and thus, a stirring effect of the balance weight is great.

The guide space S formed between the first partition wall 63 and the second partition wall 64 may be open toward the lower surface of the electric motor 20, and at the same time, may be open toward the inner surface of the casing 10 through an oil discharge port 66. The oil discharge port 66 may be a part in which a portion of the guide space S is open toward a lateral direction, and may allow oil to be efficiently discharged through the lower oil recovery flow path Pb2 without being accumulated in the guide space S.

The oil discharge port 66 may be formed in a portion of the first partition wall 63 from which a section of the first partition wall 63 is omitted. The first partition wall 63 may not have the shape of a complete circle, but may have arc shapes having some sections of a circle omitted. The first partition walls 63 may be provided on the guide body 61, and the oil discharge port 66 may be formed between the first partition walls 63. In this embodiment, the oil discharge port 66 and the first partition wall 63 may be alternately arranged along the circumferential direction of the flow path guide 60. The first partition wall 63 and the oil discharge port 66 may include two first partition walls and two oil discharge ports, respectively. Accordingly, oil may be discharged from portions open through the oil discharge port 66, and in sections in which the first partition wall 63 are located, the guide space S defined by the first partition wall 63 and the second partition wall 64 may guide refrigerant gas upward, that is, toward the electric motor 20.

The first refrigerant flow path Pa1 formed by the refrigerant discharge port 42 and 52 of the compression device 40, that is, the first refrigerant discharge port 42 and the second refrigerant discharge port 52, may be connected to the flow path guide 60. The connection hole 62 may be formed in the flow path guide 60, and may be connected to the first refrigerant flow path Pa1. Accordingly, refrigerant gas discharged to the discharge port 41*b* after being compressed in the compression device 40 may flow through the first refrigerant flow path Pa1, and may be introduced to the guide space S through the connection hole 62. Further, the refrigerant gas may be guided toward the second refrigerant flow path Pa2 provided in the electric motor 20 by the guide space S.

The connection hole 62 may be arranged between the first partition wall 63 and the second partition wall 64. Accordingly, refrigerant gas discharged to the connection hole 62 may flow toward the second refrigerant flow path Pa2 without flowing toward the oil discharge port 66. In this embodiment, the connection hole 62 may be arranged in each of two guide spaces S.

A partition fence 65 may protrude from the second partition wall 64 toward the first partition wall 63. The partition fence 65 may protrude in a direction of narrowing the guide space S, that is, in a direction orthogonal to the axial direction of the rotational shaft 30. Accordingly, due to the partition fence 65, a space between the first partition wall 63 and the second partition wall 64 may be decreased.

The partition fence 65 may be formed at a boundary between the first partition wall 63 and the oil discharge port 66. Accordingly, the partition fence 65 may function to separate the guide space S defined between the first partition wall 63 and the second partition wall 64 from the oil discharge port 66. The refrigerant gas discharged to the connection hole 62 may not flow toward the oil discharge port 66 due to the partition fence 65, but may be discharged upward.

The partition fence 65 may protrude from the second partition wall 64 toward the boundary between the first partition wall 63 and the oil discharge port 66. The partition fence 65 may include a pair of partition fences that protrude from the second partition wall 64 toward boundaries between opposing ends of the first partition wall 63 and the oil discharge port 66. The first partition wall 63 may include two first partition walls, so the partition fence 65 may include a total of four partition fences.

An end of the partition fence 65 may protrude only up to a position spaced apart from an outer edge of the guide body 61 of the flow path guide 60. That is, the partition fence 65 may not completely block the space between the first partition wall 63 and the second partition wall 64. This is intended to allow space 65' between the end of the partition fence 65 and the outer edge of the guide body 61 to be defined and to locate insulator 24 in the space 65'. That is, due to the presence of the space 65', the insulator 24 may be prevented from interfering with the flow path guide 60.

In at least a section of the oil discharge port 66, the oil discharge port 66 may overlap the lower oil recovery flow path Pb2 formed in the outer circumferential surface of the compression device 40. In this case, the oil discharge port 66 may be connected to the lower oil recovery flow path Pb2. Oil discharged through the oil discharge port 66 may be transferred to the lower oil recovery flow path Pb2, and may be recovered to the oil storage space V3.

A spacing rib 69 may be provided on an outer surface of the flow path guide 60. The spacing rib 69 may protrude from the outer circumferential surface of the flow path guide 60 in a direction increasing a diameter of the flow path guide, and may function to space the flow path guide 60 apart from the inner surface of the casing 10. Of course, a position of the flow path guide 60 may be fixed through the guide coupling hole 58 of the main frame 50, but the spacing rib 69 may more securely prevent the flow path guide 60 from being in contact with the inner surface of the casing 10.

Figure 3:
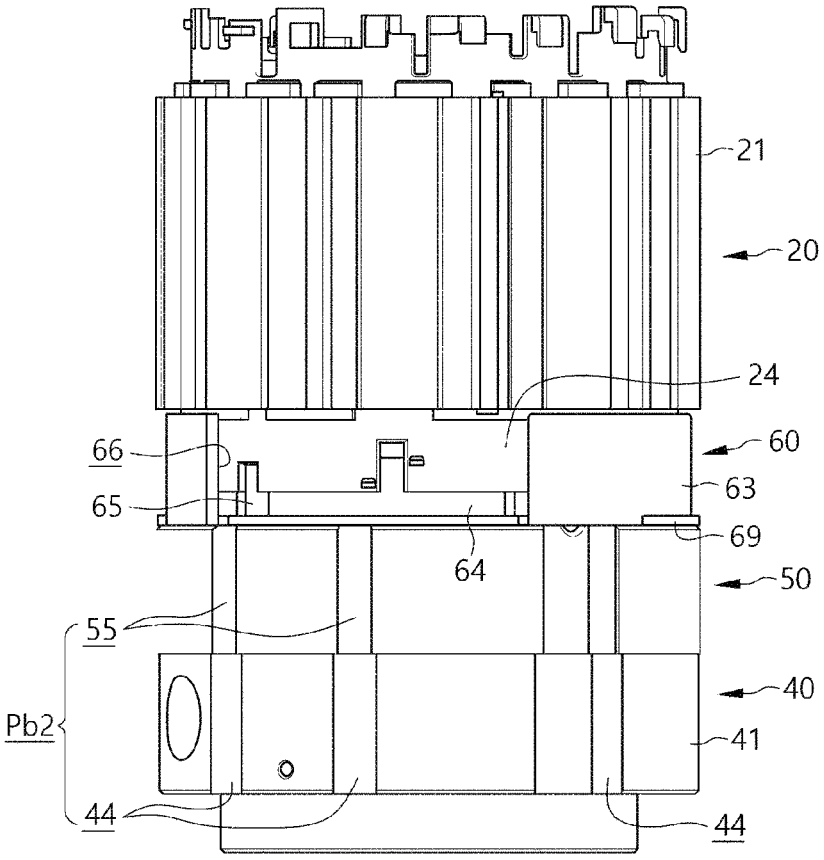
FIG. 3 is a front view of an electric motor and a compression device of the compressor according to an embodiment.

Referring to FIG. 3, the outer surface of the flow path guide 60, that is, an outer surface of the first partition wall 63 may be located at a position recessed more than the main frame 50 and the compression device 40 located under the flow path guide 60 in a direction toward the center of the flow path guide 60. Further, the outer surface of the first partition wall 63 may be located at a position recessed more than an outer surface of the electric motor 20 located on the flow path guide 60 in in the direction toward the center of the flow path guide 60. Accordingly, oil may efficiently flow downward through space between the outer surface of the first partition wall 63 and the inner surface of the casing 10.

Figure 10:
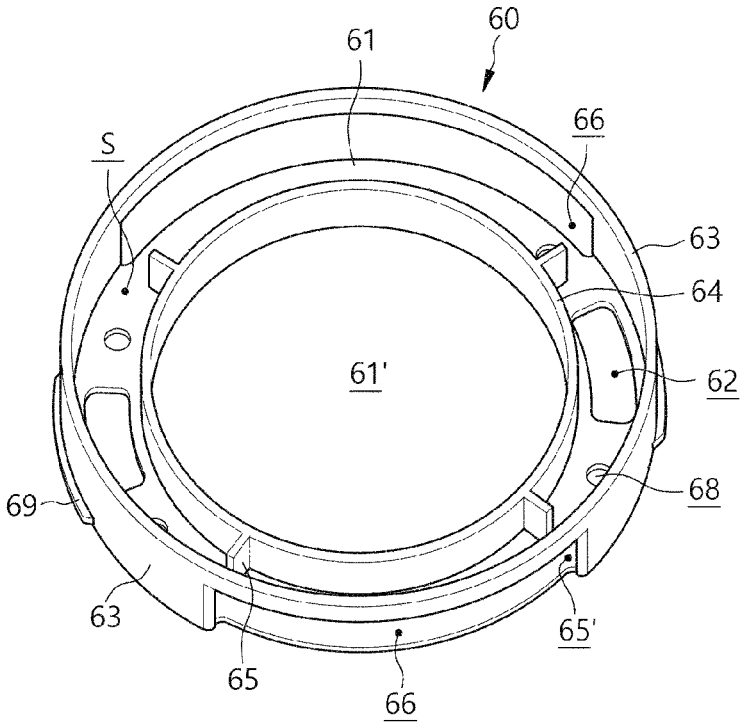
FIG. 10 is a perspective view of a flow path guide of the compressor according to another embodiment.

As illustrated in FIG. 10, in at least a section of the flow path guide 60 along the circumferential direction thereof, the first partition wall 63 may have an opening formed therethrough toward the inner surface of the casing 10, and the oil discharge port 66 may be formed in the opening formed through the first partition wall 63. That is, the first partition wall 63 may not completely be omitted, but the first partition wall 63 may have the opening formed therethrough toward the inner surface of the casing 10.

Figure 11:
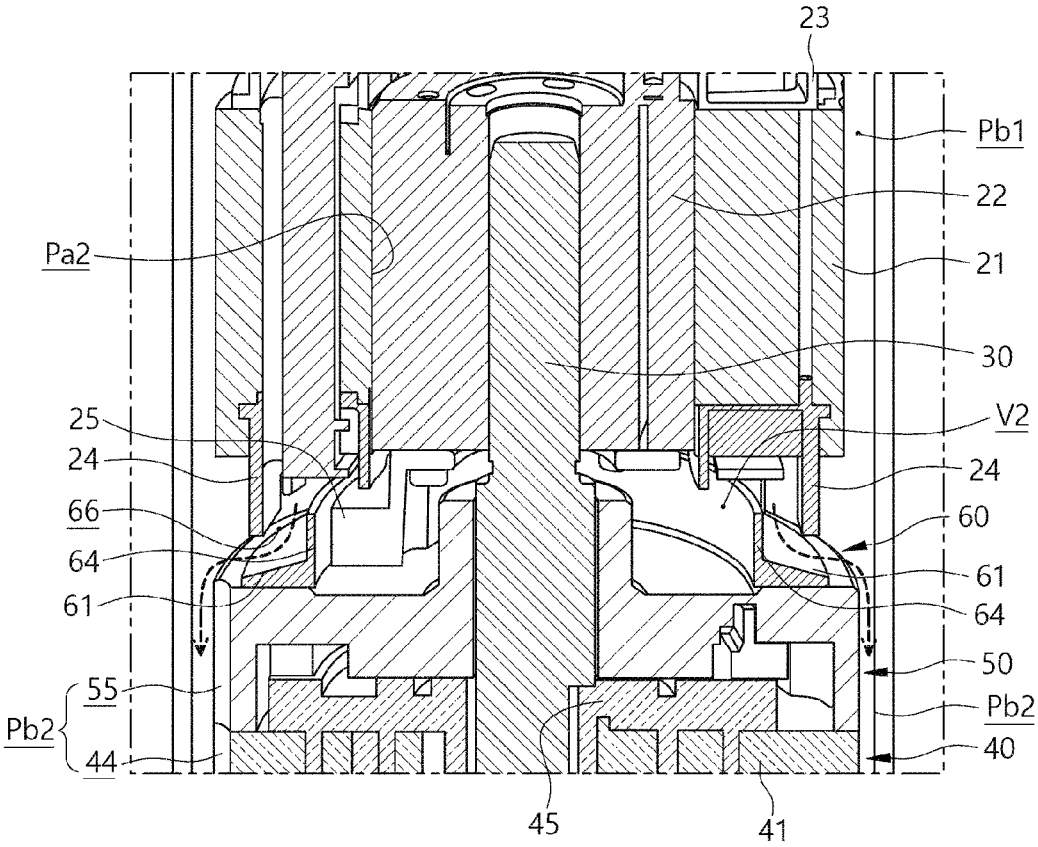
FIG. 11 is a cross-sectional view of a flow path guide of the compressor according to still another embodiment.

In addition, as illustrated in FIG. 11, a bottom surface of the guide body 61 of the flow path guide 60 may be formed to incline downward from the second partition wall 64 toward an outer edge of the flow path guide 60. Oil collected in the guide space S may naturally flow to the outside, that is, toward the inner surface of the casing 10, and finally may be induced toward the lower oil recovery flow path Pb2.

Although not shown, at least one of the first partition wall 63 or the second partition wall 64 may not be provided in the flow path guide 60, but may be provided in the main frame 50 coupled to the upper portion of the compression device 40 or may be provided in the insulator 24 provided in the electric motor 20. Additionally, in this embodiment, the flow path guide 60 may be configured as one body, but alternatively, may include multiple flow path guides. For example, the flow path guide 60 may include two flow path guides, and the oil discharge port 66 may be provided between the two flow path guides 60.

Figure 7:
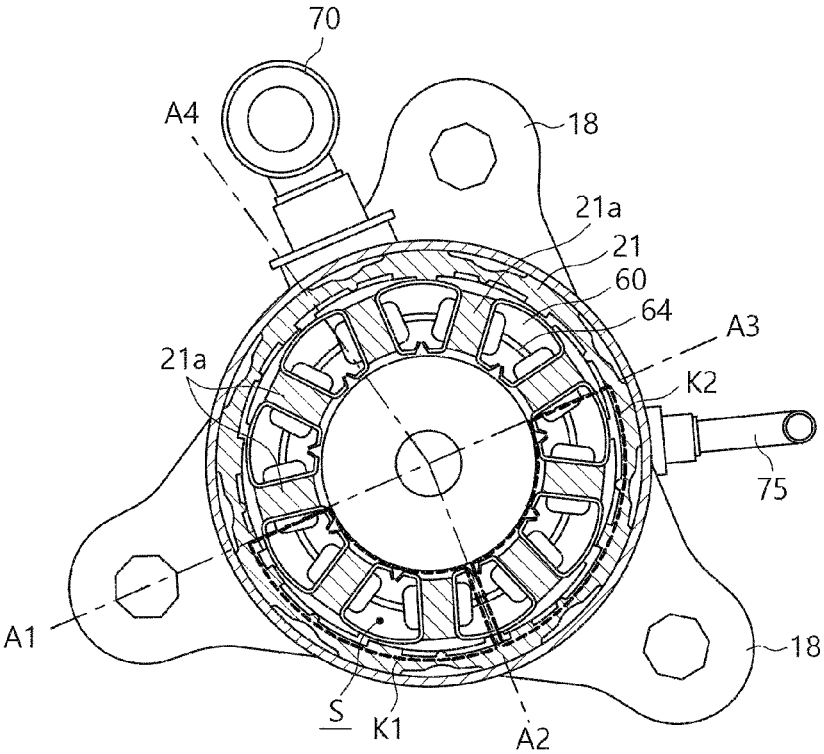
FIG. 7 is a cross-sectional view, taken along line VII-VII' of FIG. 1.
Figure 8:
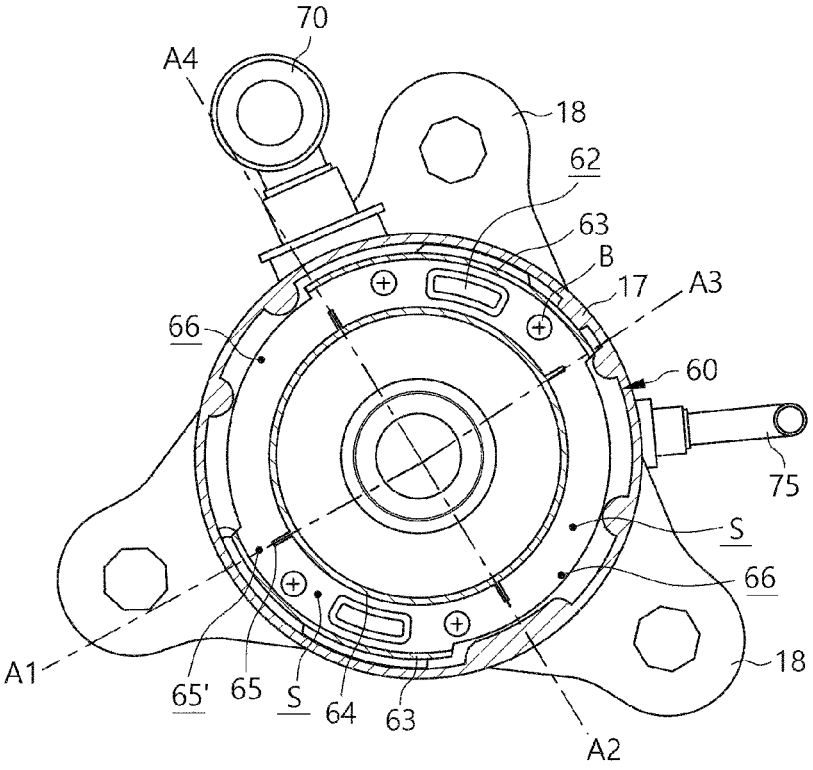
FIG. 8 is a cross-sectional view, taken along line VIII-VIII' of FIG. 1.
Figure 9:
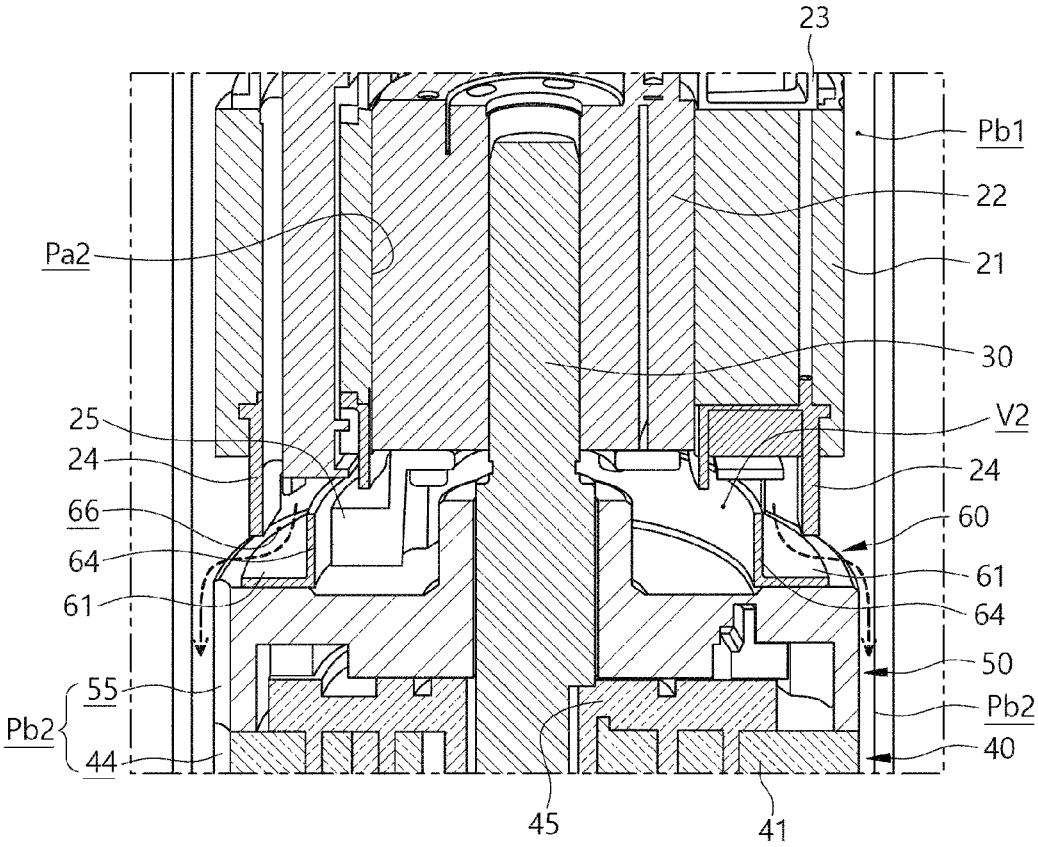
FIG. 9 is a cross-sectional view of the compression device and the flow path guide of the compressor according to an embodiment.

FIG. 7 and FIG. 8 illustrate a cross-sectional view, taken along line VII-VII' of FIG. 1, and a cross-sectional view, taken along line VIII-VIII' of FIG. 1, respectively. For reference, FIG. 7 illustrates a portion of the electric motor 20 and structure of a lower portion thereof, and FIG. 8 illustrates a portion of the flow path guide 60 and structure of a lower portion thereof, without illustrating the electric motor 20.

Referring to these drawings, there are a total of four virtual extension lines relative to a center of the compressor, and a space between two neighboring extension lines may be distinguished. For example, the first partition wall 63 may be provided between lines A1 and A2, which may define guide space S. The guide space S may guide refrigerant gas toward the second refrigerant flow path Pa2.

The second refrigerant flow path Pa2 may be a path to which refrigerant gas discharged from the first refrigerant flow path Pa1 is transferred, and may be formed in the slot 21*a* of the stator 21 and in the gap between the stator 21 and the rotor 22. A portion K1 marked in FIG. 7 may be regarded to be the second refrigerant flow path Pa2.

In addition, the first partition wall 63 is not provided but the oil discharge port 66 is provided between lines A2 and A3 of FIG. 7 and FIG. 8. Accordingly, oil may be discharged through a portion K2 marked between lines A2 and A3. That is, the oil may be transferred downward through the oil discharge port 66, and may flow to the oil storage space V3 along the lower oil recovery flow path Pb2.

Accordingly, in this embodiment, the flow path guide 60 may have a portion that discharges refrigerant gas and a portion that discharges oil, the portions being separated from each other, whereby the oil may be prevented from failing to be discharged by being accumulated in the guide space S of the flow path guide 60, or the accumulated oil may be prevented from flowing over the second partition wall 64 toward the balance weight 25 and being splattered by the balance weight 25.

Hereinafter, operation of the compressor according to an embodiment will be described.

Figure 2:
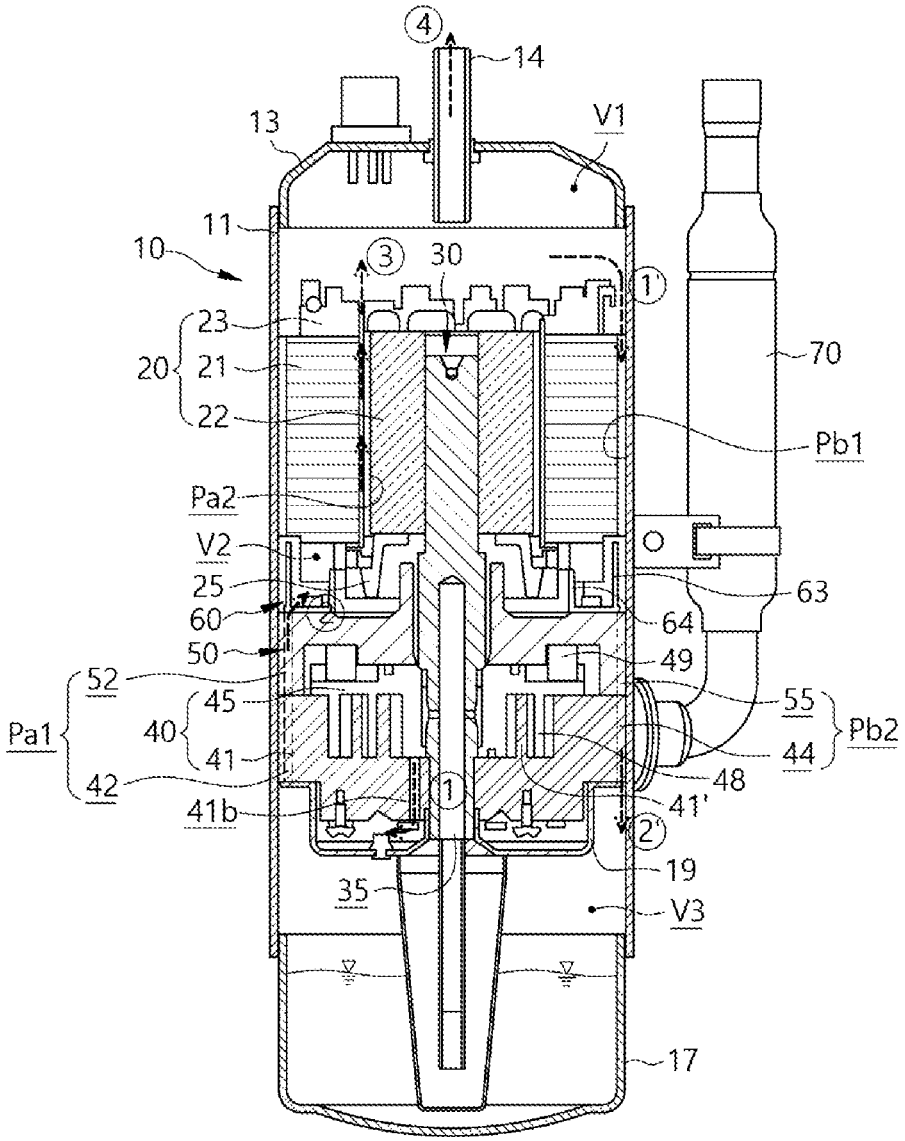
FIG. 2 is a cross-sectional view of moving paths of refrigerant gas and oil inside of the compressor according to an embodiment.

Referring to FIG. 2, first, when operation of the compressor is controlled, power may be supplied to the electric motor 20 and the rotor 22 of the electric motor 20 may rotate. When the rotor 22 rotates, the rotational shaft 30 installed to pass through the center of the rotor 22 may also rotate together with the rotor 22.

When the rotational shaft 30 rotates, the compression device 40 may operate and compress refrigerant gas in the compression chamber. That is, when the rotational shaft 30 rotates, the orbiting scroll 45 coupled eccentrically to the lower end of the rotational shaft 30 may orbit relative to the center of the rotational shaft 30. In this process, while an outer surface of the involute orbiting wrap 48 of the orbiting scroll 45 gradually moves an inner surface of the involute fixed wrap 41' of the fixed scroll 41, the compression chamber may be continuously defined, so that refrigerant gas introduced into the compression chamber may be gradually compressed.

When a refrigerant gas is compressed in the compression chamber between the fixed wrap 41' and the orbiting wrap 48, the refrigerant gas may be introduced to the refrigerant introduction port connected to the fixed scroll 41. Due to a pressure difference between the accumulator 70 and the compression chamber caused by the pressure produced in the inner portion of the fixed scroll 41, the refrigerant gas may be forcibly introduced into the compression chamber from the accumulator 70, and may be gradually compressed while flowing along the compression chamber continuously defined between the fixed wrap 41' and the orbiting wrap 48 by a continuous orbiting movement of the orbiting scroll 45.

In addition, the compressed refrigerant gas may be discharged through the discharge port 41*b* of the fixed scroll 41 to the lower portion of the compression device 40 (arrow ① of FIG. 2). Discharge cover 19 may be provided at the lower portion of the compression device 40. Accordingly, the refrigerant gas discharged through the discharge port 41*b* may be stored in the discharge cover 19. The refrigerant gas discharged to the inner space of the discharge cover 19 may circulate in the inner space of the discharge cover 19, and after the reduction of noise, may flow to the transfer space V2 through the first refrigerant flow path Pa1 (arrow ② of FIG. 2). The refrigerant gas flowing to the transfer space V2 may be guided to the second refrigerant flow path Pa2 formed in the slot 21*a* of the stator 21 and the empty space between the stator 21 and the rotor 22 by the flow path guide 60, and may flow to the discharge space V1 (arrow ③ of FIG. 2), and then may be discharged to the outside of the compressor through the refrigerant discharge tube 14 (arrow ④ of FIG. 2).

A series of process in which oil is separated from the refrigerant gas flowing to the discharge space V1, and is recovered to the oil storage space V3 through the upper oil recovery flow path Pb1 and the lower oil recovery flow path Pb2 may be repeated. More specifically, the refrigerant discharged toward the transfer space V2 from the first refrigerant flow path Pa1 may be prevented from flowing to the upper oil recovery flow path Pb1 by the first partition wall 63, and be guided toward the second refrigerant flow path Pa2. Accordingly, high-pressure refrigerant may not be introduced to the upper oil recovery flow path Pb1, and thus, flow resistance may not occur in the upper oil recovery flow path Pb1. Accordingly, the oil of the discharge space V1 may flow toward the outer surface of the first partition wall 63 through the upper oil recovery flow path Pb1, and may continuously be recovered to the oil storage space V3 through the lower oil recovery flow path Pb2.

In addition, in the transfer space V2, the second partition wall 64 may be formed between the exit of the refrigerant discharge port 42 and 52 and the rotational shaft 30, and thus, the guide space S may be defined between the first partition wall 63 and the second partition wall 64. Refrigerant gas discharged to the transfer space V2 may be guided to the slot 21*a* or the space between the stator 21 and the rotor 22 by the guide space S. Accordingly, the refrigerant gas may rapidly flow to the discharge space V1.

The guide space S may be a space located between the first partition wall 63 and the second partition wall 64, and oil may be stored in the guide space S. However, in this embodiment, the oil discharge port 66 may be provided in the flow path guide 60, and thus, the oil may directly flow toward the lower oil recovery flow path Pb2. Accordingly, the oil may be prevented from being accumulated in the flow path guide 60.

That is, in the flow path guide 60, the guide space S may guide refrigerant gas between the first refrigerant flow path Pa1 and the second refrigerant flow path Pa2 through which the refrigerant gas is discharged, and the discharge path of oil may be secured by the oil discharge port 66. Accordingly, the discharge path of the refrigerant gas and the recovery flow path of oil may be separated from each other, whereby the discharge path of the refrigerant gas may be more concentrated, and recovery of the oil may also be efficiently performed.

In this case, as described above, during compression and discharge of refrigerant gas, while the oil feeder 38 is rotated by rotation of the rotational shaft 30, oil stored in the oil storage space V3 may be suctioned upward along the oil flow path 35 formed in the rotational shaft 30 and may be sprayed to each sliding component and the electric motor 20. The oil sprayed to such sliding components and the electric motor 20 may flow down the inner wall surface the casing 10, and the refrigerant gas may be prevented from being introduced to components to which the oil flows down by the flow path guide 60 and a sealing member (not shown), so that recovery of the oil may be efficiently performed.

More precisely, the oil supplied to sliding components may be discharged between the shaft insertion hole 53 and the rotational shaft 30; may be collected in the oil pocket 54*a*; and may be recovered to the oil storage space V3 through the connection flow path 54*b* and the lower oil recovery flow path Pb2. High-pressure refrigerant gas discharged from the second refrigerant flow path Pa2 may be prevented from being introduced to the upper oil recovery flow path Pb1 by the flow path guide 60. Accordingly, oil of the upper oil recovery flow path Pb1 may not receive resistance of the refrigerant and may be efficiently recovered to the lower oil recovery flow path Pb2.

Further, the oil of the upper oil recovery flow path Pb1 may be prevented from being in contact with the refrigerant discharged from the compression device 40, so that the refrigerant gas of the transfer space V2 and the oil may be prevented from being mixed with each other by the rotational shaft 30 or the balance weight 25. Accordingly, oil of the transfer space V2 may be efficiently prevented from mixing with refrigerant gas and being introduced to the discharge space V1.

Referring to a recovering process of oil mixing with refrigerant gas, the oil may be collected in the transfer space V2 corresponding to the inner space of the flow path guide 60 and the upper portion of the main frame 50, and then may be introduced to the discharge space V1 through the second refrigerant flow path Pa2 (arrow ①' of FIG. 2). Further, the oil separated from the refrigerant gas in the discharge space V1 may flow to the upper oil recovery flow path Pb1; may pass by the outer surface of the first partition wall 63; and may flow to the oil storage space V3 through the lower oil recovery flow path Pb2 (arrow ②' of FIG. 2).

Accordingly, embodiments have been configured keeping in mind problems occurring in the related art, and embodiments provide a compressor, in which flowing paths of oil and refrigerant gas are separated from each other by a flow path guide, and oil is efficiently recovered to an oil storage space without being accumulated in the flow path guide. In addition, embodiments provide a compressor, in which oil is efficiently discharged toward the oil storage space by the flow path guide such that the oil does not flow toward a balance weight. Further, embodiments provide a compressor, in which the flow path guide allows the discharge path of refrigerant gas to be concentrated on a predetermined section.

Embodiments disclosed herein provide a compressor that may include a casing; an electric motor provided in the casing and that operates a rotational shaft, and a compression device. A flow path guide may be installed between the electric motor and the compression device, and may separate a refrigerant flow path from an oil flow path. The flow path guide may have a first partition wall and a second partition wall which are spaced apart from each other. In addition, the flow path guide may have an oil discharge port formed in at least a section of the flow path guide along a circumferential direction thereof, the oil discharge port allowing a guide space between the first partition wall and the second partition wall to be open toward the inner surface of the casing.

In addition, the flow path guide may include a ring-shaped guide body having a through hole formed in a center thereof, the first partition wall, and the second partition wall. The first partition wall may have an arc shape along an outer edge of the guide body, and the second partition wall may be provided to have a circular shape along an edge of the through hole. The second partition wall may define the guide space in cooperation with the guide body and the first partition wall. Additionally, the guide space may be open toward a lower surface of the electric motor, and may be open toward the inner surface of the casing through the oil discharge. Further, the oil discharge and the first partition wall may be alternately arranged along a circumferential direction of the flow path guide.

In addition, the first partition wall may be omitted in at least a section of the flow path guide along the circumferential direction of the flow path guide, and the oil discharge port may be formed in the omitted section of the first partition wall. Additionally, in at least a section of the flow path guide along the circumferential direction thereof, the first partition wall may have an opening formed therethrough toward the inner surface of the casing, and the oil discharge port may be formed in the opening of the first partition wall.

A connection hole connected to the refrigerant discharge port of the compression device may be formed in the flow path guide, and may be arranged between the first partition wall and the second partition wall. Each of the first partition wall and the second partition wall may be provided to have an arc or circular shape in the flow path guide. Further, each of the upper ends of the first partition wall and the second partition wall may extend in the axial direction of the rotational shaft.

The first partition wall may protrude from the guide body of the flow path guide toward a lower surface of the electric motor. The upper end of the first partition wall may be in close contact with the electric motor or may extend up to a position adjacent to the electric motor.

The second partition wall may protrude from the guide body of the flow path guide toward the lower surface of the electric motor. The upper end of the second partition wall may protrude to have a height higher than or the same height as a height of an edge of an end in a circumferential direction of a balance weight arranged closer to the rotational shaft than the flow path guide.

The first partition wall or the second partition wall may have a partition fence that protrudes toward a side facing each other. The partition fence may be formed at a boundary between the first partition wall and the oil discharge port. The partition fence protruding toward the boundary between the first partition wall and the oil discharge port may be connected to the second partition wall. The end of the partition fence may protrude only up to a position spaced apart from the outer edge of the guide body of the flow path guide, so a space may be defined between the end of the partition fence and the outer edge of the guide body.

A pair of partition fences may protrude from the second partition wall toward boundaries between opposing ends of the first partition wall and the oil discharge port. In this case, in at least a section of the oil discharge port, the oil discharge part may be formed to overlap a recovery flow path of oil formed in the outer circumferential surface of the compression device.

At least one of the first partition wall or the second partition wall may be provided in a main frame coupled to the upper portion of the compression device, or may be provided in an insulator provided in the electric motor. Additionally, the first partition wall may extend higher than the second partition wall along the direction of the rotational shaft.

The guide body connecting the lower end of the first partition wall and the lower end of the second partition wall therebetween may be provided in the flow path guide. A bottom surface of the guide body may be formed to incline downward from the second partition wall toward the outer edge of the flow path guide.

The compressor according to embodiments disclosed herein has at least the following advantages.

According to embodiments disclosed herein, the discharge path of refrigerant gas and the recovery flow path of oil may be separated from each other by the flow path guide, so that oil recovery may be prevented from interfering with discharging of refrigerant gas, and at the same time, the oil discharge port may be open in the flow path guide in the direction of the inner surface of the casing, so oil may not be accumulated in the flow path guide, but may be efficiently recovered to an oil storage space. Accordingly, abrasion or friction loss of compressor during operation caused by an oil shortage inside of the compressor may be prevented, thereby improving durability and efficiency of the compressor.

In addition, according to embodiments disclosed herein, in the flow path guide, the oil discharge port entirely open toward the inner surface of the casing may be formed in various sections, so oil may be directly discharged without being accumulated inside of the flow path guide. Accordingly, a recovery speed of oil may be increased, and thus, a sufficient amount of oil may always be stored in the oil storage space, thereby facilitating oil supply to operating components.

Furthermore, according to embodiments disclosed herein, the balance weight may be arranged between the flow path guide and the rotational shaft, and oil may be directly discharged through the oil discharge port, so that the amount of the oil flowing from the flow path guide toward the balance weight may be greatly reduced, thereby preventing oil from being splattered by the balance weight and failing to be recovered.

Additionally, the partition fence may be provided in the flow path guide according to embodiments disclosed herein, so the section guiding the discharge of refrigerant gas and the section recovering oil may be more securely separated from each other. Accordingly, a path guiding the discharge of refrigerant gas may be further concentrated, and discharge of refrigerant gas may also be facilitated, thereby increasing performance of the compressor.

In addition, the bottom surface of the flow path guide according to embodiments disclosed herein may be inclined downward to the outside, thereby discharging oil more efficiently.

In the above description, embodiments are not necessarily limited to these embodiments, although all elements constituting embodiments according are described as being combined or operating in combination. That is, within the scope, all of the components may be selectively combined to operate in one or more. In addition, the terms "include", "constitute", or "having" described above mean that the corresponding component may be inherent unless otherwise stated. Accordingly, it should be construed that other components may be further included instead of being excluded. All terms, including technical and scientific terms, have the same meaning as commonly understood by ones of ordinary skills in the art to which embodiments belong unless otherwise defined. Commonly used terms, such as those defined in a dictionary, should be construed as consistent with the contextual meaning of the related art and shall not be construed in an ideal or excessively formal sense unless explicitly defined in the present disclosure.

The above description is merely illustrative of the technical idea, and those skilled in the art to which embodiments belong may make various modifications and changes without departing from the essential characteristics of the present disclosure. Accordingly, embodiments disclosed herein are not intended to limit the technical spirit, but to describe embodiments, and the scope of the technical spirit is not limited by these embodiments. The scope of protection should be interpreted by the following claims, and all technical ideas within the scope should be construed as being included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing;

an electric motor provided inside of the casing and that that operates a rotational shaft;

a compression device including a compression chamber, wherein the compression device is located under the electric motor in the casing and compresses a refrigerant gas in the compression chamber by being operated by the electric motor via the rotational shaft and discharges the compressed refrigerant gas from the compression chamber to a refrigerant discharge port; and a flow path guide installed between the electric motor and the compression device and that separates a refrigerant flow path from an oil flow path, wherein the flow path guide includes a first partition wall and a second partition wall which are spaced apart from each other, wherein the first partition wall is arranged between an inner surface of the casing and the refrigerant discharge port of the compression device, wherein the second partition wall is arranged closer to the rotational shaft than the first partition wall in a radial direction of the flow path guide, so that a guide space is defined between the first partition wall and the second partition wall, and wherein an oil discharge port is formed in at least a section of the flow path guide along a circumferential direction thereof, the oil discharge port allowing the guide space to be open toward the inner surface of the casing.

2. The compressor of claim 1, wherein the flow path guide comprises:

a ring-shaped guide body having a through hole formed in a center thereof, wherein the first partition wall has a circular or arc shape along an outer edge of the guide body, and wherein the second partition wall has a circular shape along an edge of the through hole and defines the guide space in cooperation with the guide body and the first partition wall, and wherein the guide space is open toward a lower surface of the electric motor and toward the inner surface of the casing through the oil discharge port.

3. The compressor of claim 1, wherein the oil discharge port and the first partition wall are alternately arranged along the circumferential direction of the flow path guide.

4. The compressor of claim 1, wherein the first partition wall is omitted in at least a section of the flow path guide along the circumferential direction thereof, and wherein the oil discharge port is formed in the omitted section of the first partition wall.

5. The compressor of claim 1, wherein the first partition wall has an opening formed therethrough toward the inner surface of the casing in at least a section of the flow path guide along the circumferential direction thereof, and wherein the oil discharge port is formed in the opening formed through the first partition wall.

6. The compressor of claim 1, wherein a connection hole connected to the refrigerant discharge port of the compression device is formed in the flow path guide, and is arranged between the first partition wall and the second partition wall.

7. The compressor of claim 1, wherein each of the first partition wall and the second partition wall has an arc or circular shape in the flow path guide, and wherein upper ends of each of the first partition wall and the second partition wall extends in an axial direction of the rotational shaft.

8. The compressor of claim 1, wherein the first partition wall protrudes from a guide body of the flow path guide toward a lower surface of the electric motor, and wherein an upper end of the first partition wall is in close contact with the electric motor or extends up to a position adjacent to the electric motor.

9. The compressor of claim 1, wherein the second partition wall protrudes from a guide body of the flow path guide toward a lower surface of the electric motor, wherein an upper end of the second partition wall protrudes to a height higher than or the same as a height of an edge of an end in a circumferential direction of a balance weight arranged closer to the rotational shaft than the flow path guide.

10. The compressor of claim 1, wherein the first partition wall or the second partition wall includes a partition fence that protrudes therefrom toward the other of the first partition wall or the second partition wall, and wherein the partition fence is formed at a boundary between the first partition wall and the oil discharge port.

11. The compressor of claim 1, wherein a partition fence that protrudes toward a boundary between the first partition wall and the oil discharge port is connected to the second partition wall, and wherein an end of the partition fence protrudes only up to a position spaced apart from an outer edge of a guide body of the flow path guide, so that a space is defined between the end of the partition fence and the outer edge of the guide body.

12. The compressor of claim 1, wherein a pair of partition fences protrudes from the second partition wall toward boundaries between opposing ends of the first partition wall and the oil discharge port.

13. The compressor of claim 1, wherein in at least a section of the oil discharge port, the oil discharge port overlaps a recovery flow path for oil formed in an outer circumferential surface of the compression device.

14. The compressor of claim 1, wherein at least one of the first partition wall and the second partition wall is provided in a main frame coupled to an upper portion of the compression device, or is provided in an insulator provided in the electric motor.

15. The compressor of claim 1, wherein the first partition wall extends higher than the second partition wall in an axial direction of the rotational shaft.

16. The compressor of claim 1, wherein the flow path guide includes a guide body that connects a lower end of the first partition wall to a lower end of the second partition wall, and wherein a bottom surface of the guide body is inclined downward from the second partition wall toward an outer edge of the flow path guide.

17. The compressor of claim 1, wherein at least one spacing rib protrudes from an outer surface of the flow path guide toward the inner surface of the casing.

18. The compressor of claim 1, wherein the compressor is a scroll compressor and the compression device further comprises a fixed scroll and an orbiting scroll.

19. A compressor, comprising:

a casing;

an electric motor provided inside of the casing and that operates a rotational shaft;

a compression device including a compression chamber, wherein the compression device is located under the electric motor in the casing and compresses refrigerant gas in the compression chamber by being operated by the electric motor via the rotational shaft and discharges the compressed refrigerant gas from the compression chamber to a refrigerant discharge port;

a main frame located between the electric motor and the compression device, wherein the main frame supports the compression device and the rotational shaft; and a flow path guide installed on the main frame and that separates a refrigerant flow path from an oil flow path, wherein the flow path guide includes a first partition wall and a second partition wall which are spaced apart from each other, wherein the first partition wall extends along an outer edge of the flow path guide such that the first partition wall faces an inner surface of the casing, wherein the second partition wall has a radius smaller than a radius of the first partition wall and is arranged closer to the rotational shaft than the first partition wall, so that a guide space is defined between the first partition wall and the second partition wall, and wherein a section of the first partition wall is omitted or the first partition wall has an opening formed therethrough toward the inner surface of the casing, to form an oil discharge port in the flow path guide.

20. The compressor of claim 19, wherein the compressor is a scroll compressor and the compression device further comprises a fixed scroll and an orbiting scroll.

* * * * *